US005435113A

United States Patent [19]

Oikawa

[11] Patent Number: 5,435,113

[45] Date of Patent: Jul. 25, 1995

[54] COIN WRAPPING APPARATUS

[75] Inventor: Yoshio Oikawa, Okegawa, Japan

[73] Assignee: Laurel Bank Machines Co., Ltd., Tokyo, Japan

[21] Appl. No.: 130,175

[22] Filed: Oct. 1, 1993

[30] Foreign Application Priority Data

Oct. 2, 1992 [JP] Japan ..... 4-287082
Sep. 28, 1993 [JP] Japan ..... 5-240990

[51] Int. Cl.[6] ..... B65B 11/04; B65B 57/02

[52] U.S. Cl. ..... 53/212; 53/64; 53/504; 53/505; 53/532

[58] Field of Search ..... 53/212, 505, 504, 66, 53/64, 77, 507, 508, 168, 532

[56] References Cited

U.S. PATENT DOCUMENTS

| | | | |
|---|---|---|---|
| 4,257,208 | 3/1981 | Uchida | 53/212 |
| 4,333,296 | 6/1982 | Watanabe | 53/64 |
| 4,674,260 | 6/1987 | Rasmussen et al. | 53/212 |
| 4,677,811 | 7/1987 | Brisebarre | 53/212 X |
| 4,951,448 | 8/1990 | Schmechel | 53/66 X |
| 5,105,601 | 4/1992 | Horiguchi et al. | 53/212 X |

FOREIGN PATENT DOCUMENTS

| | | |
|---|---|---|
| 58-56165 | 12/1983 | Japan . |
| 2110635 | 6/1983 | United Kingdom . |

*Primary Examiner*—James F. Coan
*Attorney, Agent, or Firm*—Cushman, Darby & Cushman

[57] ABSTRACT

A coin wrapping apparatus that includes a denomination setting dial, a wrapping film width detector, a plurality of wrapping rollers for winding the wrapping film around a predetermined number of stacked coins, a coin support post, a coin support post moving mechanism for moving the coin support post between a waiting position, a wrapping position and a retracted position. The coin wrapping apparatus further includes a wrapping position adjusting mechanism for separately adjusting the vertical position of the coin support post and a controller for driving the wrapping position adjusting mechanism based upon the denomination of coins to be wrapped which is set with the denomination setting dial and the width of the wrapping film as detected by the wrapping film width detector, so that a vertical center of the stacked coins coincides with the widthwise center of the wrapping film at the wrapping position. With such an apparatus, it is possible to ensure that wrapping film portions for crimping having the same desired width are formed to project from the upper and lower ends of a roll of stacked coins so that the wrapping film can be crimped in a desired manner to obtain a desired wrapped coin roll.

4 Claims, 7 Drawing Sheets

COIN WRAPPING APPARATUS

BACKGROUND OF THE INVENTION

The present invention relates to a coin wrapping apparatus and, in particular, to such a apparatus which can wrap a predetermined number of roll-like stacked coins so that portions of a wrapping film having the same predetermined width project from the upper and the lower ends of the stacked coins.

DESCRIPTION OF PRIOR ART

A coin wrapping apparatus is generally constituted so that a predetermined number of coins are stacked by a coin stacking device, that a wrapping film is wound around the roll-like stacked coins and that the portions of the wrapping film projecting beyond the upper and the lower ends of the roll-like stacked coins are crimped so as to form a wrapped coin roll. However, since the thicknesses of coins generally varies with the coin denomination, the height of the stacked coins to be wrapped depends upon the denomination of the coins. As a result, unless the relationship between the vertical position of the stacked coins and the width of the wrapping film is adjusted in accordance with the denomination of the coins to be wrapped, the widths of the portions of the wrapping film which project beyond the upper and lower ends of the stacked coins after the wrapping film has been wounded around a predetermined number of the roll-like stacked coins will be different. There therefore arises a problem that the wrapped film cannot be crimped in a desired manner and the desired coin roll cannot be obtained.

In view of above, Japanese Utility Model Publication No. 58-56165 proposes a coin wrapping apparatus in which when stacked coins are wrapped by a wrapping film having a predetermined width, the position of the stacked coins is moved in the vertical direction so that the vertical center portion of the stacked coins to be wrapped coincides with the widthwise center position of the wrapping film.

However, in this coin wrapping apparatus, since the cam profile of a cam for setting the position of the stacked coins can set the position for only two denominations, it is impossible to position and wrap all denominations of coins so that the vertical center position of the stacked coins coincides with the widthwise center portion of the wrapping film and, therefore, the coins cannot be wrapped in a desired manner.

Further, since the coin wrapping apparatus is constituted so that the vertical position of the stacked coins can be set only for a wrapping film having the predetermined width, even if the vertical center position of the stacked coins coincides with the widthwise center portion of the wrapping film, the widths of the wrapping film portions projecting at the upper and lower ends of the stacked coins may be too large or too small depending upon the thickness of the coins to be wrapped and, therefore, the coins are sometimes not wrapped in a desired manner.

SUMMARY OF THE INVENTION

It is, therefore, an object of the present invention to provide a coin wrapping apparatus which can ensure that wrapping film portions for crimping that have the same and desired width are formed to project from the upper and lower ends of a roll of a predetermined number of stacked coins irrespective of the coin thickness and the wrapping film width and which can produce wrapped coin rolls enabling the wrapping film to be crimped in a desired manner.

The above and other objects of the present invention can be accomplished by a coin wrapping apparatus comprising denomination setting means to be operated by an operator for setting the denomination of coins to be wrapped, wrapping film width detection means for detecting the width of a wrapping film, coin stacking means for stacking coins to be wrapped, a plurality of wrapping rollers for winding the wrapping film around a predetermined number of stacked coins for wrapping, coin support means for supporting the stacked coins on the upper face thereof and coin support means moving mechanism for moving the coin support means between a waiting position where the stacked coins are to be received by the coin support means, a wrapping position where the stacked coins are to be wrapped by the wrapping rollers and a retracted position where the coin support means is retracted from the wrapping position, the coin wrapping apparatus further comprising wrapping position adjusting means for steplessly adjusting the vertical position of the coin support means at the wrapping position and control means for driving the wrapping position adjusting means based upon the denomination of coins to be wrapped which is set by the denomination setting means and the width of the wrapping film detected by the wrapping film width detection means so that the vertical center position of the stacked coins supported on the coin support means coincides with the widthwise center position of the wrapping film at the wrapping position.

In a preferred aspect of the present invention, the coin wrapping apparatus further includes wrapping film width data storing means for storing width data on the width of the wrapping film suitable for wrapping the stacked coins of each denomination and warning means and the control means is adapted for reading from the wrapping film width data storing means the width data of the wrapping film corresponding to the denomination of coins to be wrapped which is set by the denomination setting means, judging, based upon the denomination set by the denomination setting means and the width of the wrapping film detected by the wrapping film width detection means, whether or not the coins to be wrapped can be wrapped by the wrapping film and, if they cannot outputting a warning signal to the warning means, thereby causing it to produce a warning.

In a further preferred aspect of the present invention, the wrapping film width data storing means stores, as the width data on the wrapping film, a maximum value and a minimum value of the width of the wrapping film able to wrap each denomination of coins and the control means is adapted for calculating the difference between the width of the wrapping film and the height of the stacked coins based upon the denomination set by the denomination setting means and the width of the wrapping film detected by the wrapping film width detection means and judging whether or not the coins of the denomination set by the denomination setting means can be wrapped by the wrapping film.

In still another preferred aspect of the present invention, the wrapping film width data storing means stores, as the width data on the wrapping film, a maximum tolerance value and a minimum tolerance value of the difference between the width of the wrapping film and the height of the stacked coins of the denomination set by the denomination setting means for each denomination of coins and the control means is adapted for calculating the difference between the width of the wrapping film and the height of the stacked coins to be wrapped based upon the width of the wrapping film detected by the wrapping film width detection means and the denomination of coins to be wrapped which is set by the denomination setting means and judging whether or not the coins of the denomination set by the denomination setting means can be wrapped by the wrapping film by comparing the difference with the maximum tolerance value and the minimum tolerance value.

DESCRIPTION OF THE PREFERRED EMBODIMENT

Figure 1:
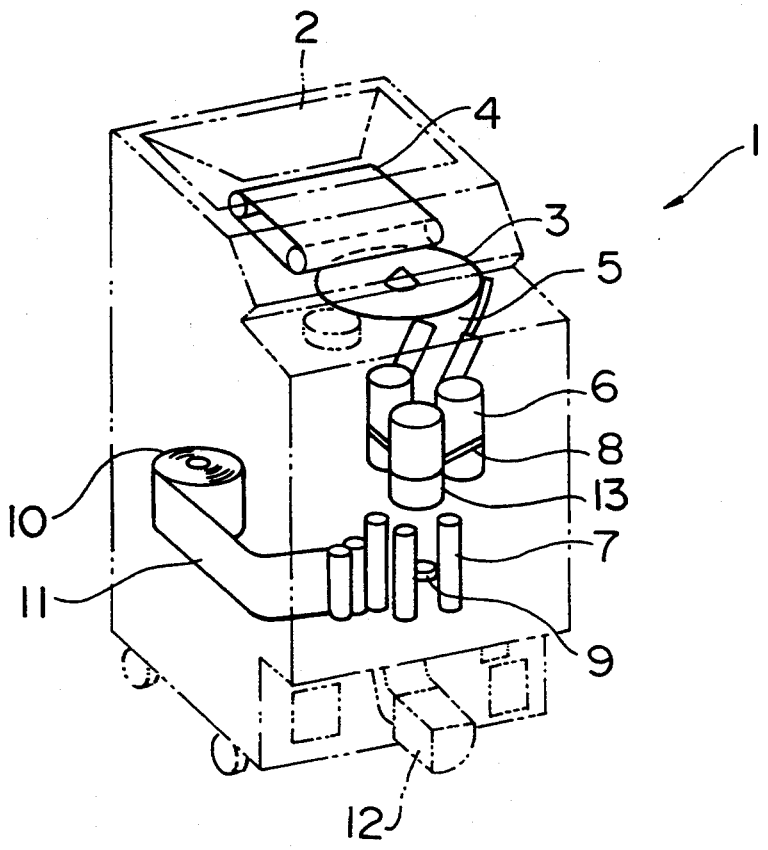
FIG. 1 is a schematic front view of a coin wrapping apparatus which is an embodiment of the present invention.

Referring to FIG. 1, a coin wrapping apparatus 1 comprises a hopper 2 into which coins are deposited, a transporting belt 4 for transporting coins deposited into the hopper 2 onto a rotatable disk 3, a coin sorting passage 5 connected with the rotatable disk 3 for sorting coins to be wrapped in accordance with the diameters thereof, a pair of stacking drums 6 connected with the downstream portion of the coin sorting passage 5 for stacking coins therebetween and three wrapping rollers 7 disposed below the pair of stacking drums 6. These structures of the coin wrapping apparatus 1 are well known. The outer surface of each stacking drum 6 is formed with a spiral projection whose the upper face supports coins and when a predetermined number of coins have been stacked between the pair of stacking drums 6, the stacked coins are transferred onto a shutter (not shown) disposed below a pair of the stacking drums 6. Thereafter, the stacked coins are received by the upper face of a coin support post 9 waiting immediately below the shutter and are fed to a wrapping position between the three wrapping rollers 7 in accordance with the lowering of the coin support post 9 so that a wrapping film 11 such as paper, plastic or the like fed from a wrapping film roll 10 is wound around them. Since the width of the wrapping film is greater than the height of the stacked coins, after the stacked coins have been wrapped, portions of the wrapping film project beyond the upper and lower ends of the stacked coins. These portions are crimped by a pair of crimping claws (not shown) to produce a wrapped coin roll that is fed to the outside through a chute 12. The reference numeral 13 designate a guide for the stacked coins.

The coin wrapping apparatus 1 according to this embodiment comprises a wrapping position setting mechanism for setting the wrapping position of the stacked coins supported by the coin support post 9 in the vertical direction, a coin support post moving mechanism for moving the coin support post 9 between a waiting position where the coins stacked by the stacking drums 6 are received by the coin support post 9, a wrapping position where the stacked coins are wrapped by the wrapping rollers 7 and the wrapping film 11 is crimped by the crimping claws (not shown) and a retracted position below the wrapping position, a wrapping film width detection mechanism for detecting the width of the wrapping film 11, a control mechanism for controlling the wrapping position setting mechanism, the coin support post moving mechanism and a drive means (not shown), an operation mechanism operated by an operator and a message mechanism for providing the operator with necessary information.

Figure 2:
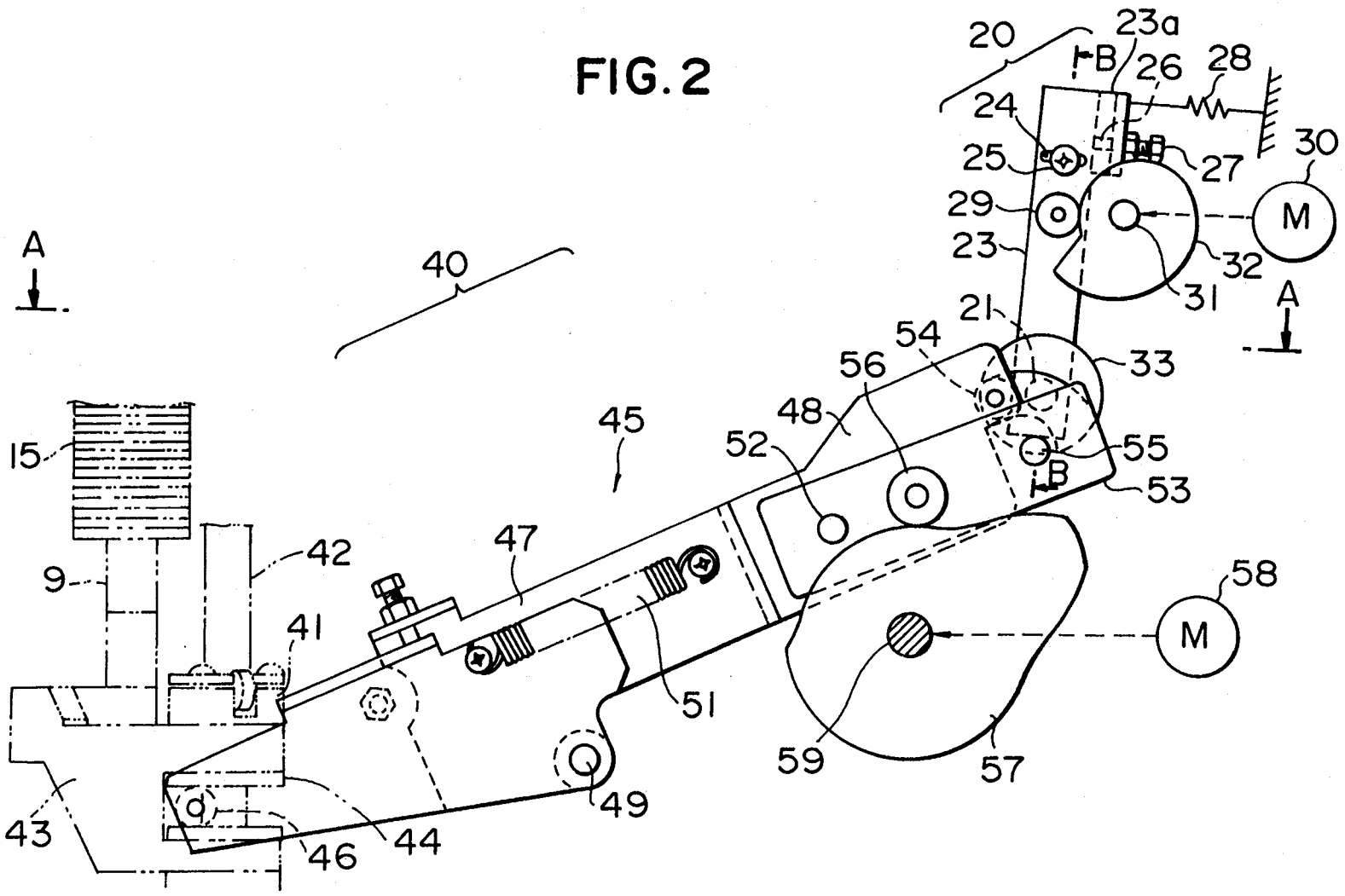
FIG. 2 is a schematic drawing showing a cross sectional view of a wrapping position setting mechanism and a coin support post moving mechanism.
Figure 3:
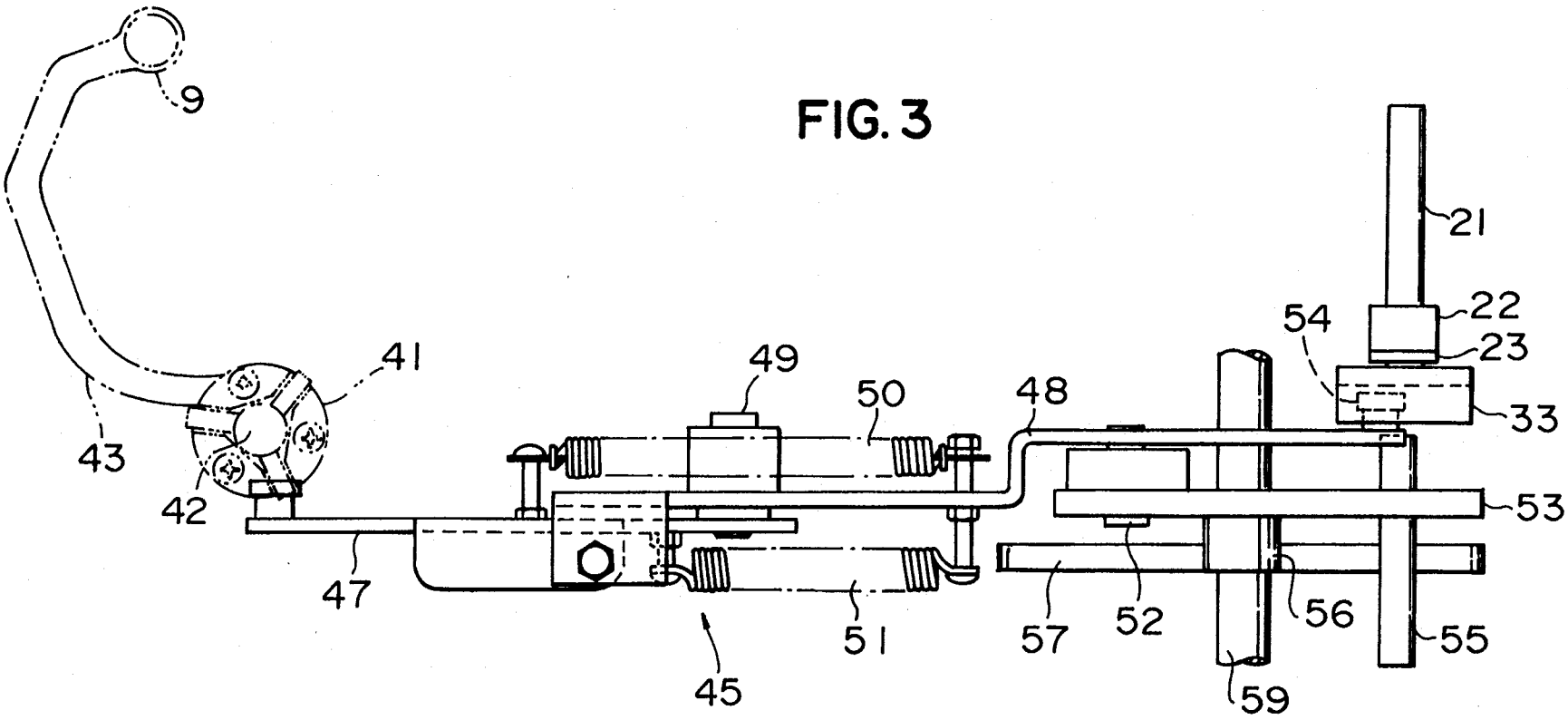
FIG. 3 is a schematic drawing showing a cross sectional view taken on line A—A in FIG. 2.
Figure 4:
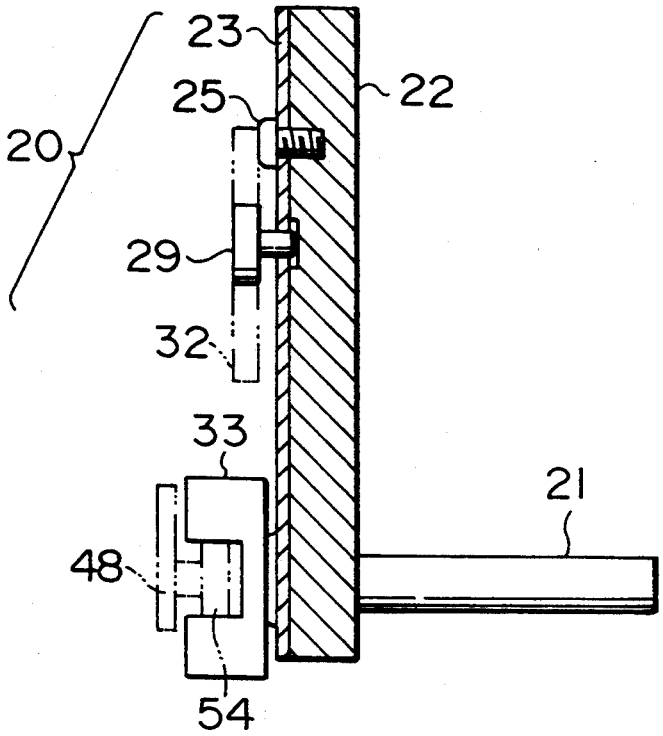
FIG. 4 is a schematic drawing showing a cross sectional view taken on line B—B in FIG. 2.

FIG. 2 is a schematic drawing showing a cross sectional view of the wrapping position setting mechanism and the coin support post moving mechanism, FIG. 3 is a schematic drawing showing a cross sectional view taken on line A—A in FIG. 2 and FIG. 4 is a schematic drawing showing a cross sectional view taken on line B—B in FIG. 2.

In FIGS. 2, 3 and 4, the wrapping position setting mechanism 20 comprises a shaft 21 one end of which is rotatably mounted on the body (not shown) of the coin wrapping apparatus 1, a block 22 fixed to the shaft 21 and an arm 23 swingably mounted on the shaft 21. The block 22 and the arm 23 are fixed to each other by a screw 25 inserted through a slot 24 formed in the arm 23 and the arm 23 is rotatable with respect to the block 22 by an adjusting screw 27 inserted through an aperture 26 formed in a extensible portion **23*a* of the arm 23 and abutting against the right side surface of the block 22. One end of a tension spring 28 whose other is secured to the body of the coin wrapping apparatus 1 is secured to the extensible portion 23*a* of the arm whereby the arm 23 is biased clockwise about the shaft 21 in FIG. 2**.

A cam follower 29 is rotatably mounted on the arm 23 and a first cam 32 fixed to a cam shaft 31 rotatable by a motor 30 is provided in such manner that the cam follower 29 is abutted against the cam surface of the first cam 32 by the spring force of the tension spring 28. The cam surface of the first cam 32 is formed as a involute curve. The cam shaft 31 is connected with a rotary encoder (not shown) for monitoring the amount of rotation of the first cam 32.

As shown in FIGS. 2 and 4, a second cam 33 is fixed to the other end portion of the shaft 21 and has a groove-like cam surface.

In this embodiment, the wrapping position setting mechanism 20 is adapted for setting the wrapping position where the roll-like coins 15 stacked by the pair of stacking drums 6 are to be wrapped by the wrapping rollers 7 so that the vertical center position of the stacked coins 15 coincides with the widthwise center position of the wrapping film 11.

Further, a coin support post moving mechanism 40 of the coin wrapping apparatus 1 according to this embodiment is adapted for moving the coin support post 9 from a waiting position immediately below the shutter (not shown) to a wrapping position between the three wrapping rollers 7 and after the wrapping of the stacked coins 15 supported by the upper face of the coin support post 9 and the crimping of the projecting upper and lower edge portions of the wrapping film 11 by crimping claws (not shown), moving the coin support post 9 to a retracted position where it is retracted downwardly from between the three wrapping rollers 7 and further to the waiting position.

As shown in FIG. 3, the coin support post moving mechanism 40 comprises an arm 43 one end portion of which has the coin support post 9 fixed thereto and the other end portion of which is swingably supported by a shaft 42 via a block 41. As shown in FIG. 2, the block 41 is supported movably in the vertical direction by the shaft 42 and the lower face thereof is formed with a groove 44. The groove 44 of the block 41 is engaged with a roller 46 rotatably mounted on one end portion of a transmission member 45.

The transmission member 45 comprises two arms 47 and 48 which are swingably mounted on a shaft 49. Tension springs 50, 51 are secured between the arms 47, 48. Ordinary, the arms 47, 48 serves as an integral member, but when a load of greater than a predetermined magnitude acts on the transmission member 45, the arms 47, 48 are swung about the shaft 49 so as to absorb the load. The arm 48 is swingably mounted on a shaft 52 and an arm 53 is also swingably mounted on the shaft 52.

A cam follower 54 is rotatably mounted on the end portion of the arm 48 on the opposite side of the shaft 52 from the shaft 49 and abuts against the groove-like cam surface of the second cam 33.

The arm 53 is swingably mounted on a shaft 55 fixed to the body (not shown) of the coin wrapping apparatus 1 and a cam follower 56 is rotatably mounted on substantially a central portion of the arm 53 in the longitudinal direction thereof. The cam follower 56 abuts against a third cam 57.

The third cam 57 is fixed to a cam shaft 59 rotatable by a motor 58. The profile of the third cam 57 is such that a single revolution of the third cam 57 acts via the cam follower 56 abutting against the cam surface thereof, the transmission member 45, the roller 46, the block 41 and the arm 43 to move the coin support post 9 from the waiting position immediately below the shutter (not shown) through the wrapping position between the three wrapping rollers 7 and the retracted position where the coin support post 9 is retracted downwardly from between the three wrapping rollers 7, and back to the waiting position.

Figure 5:
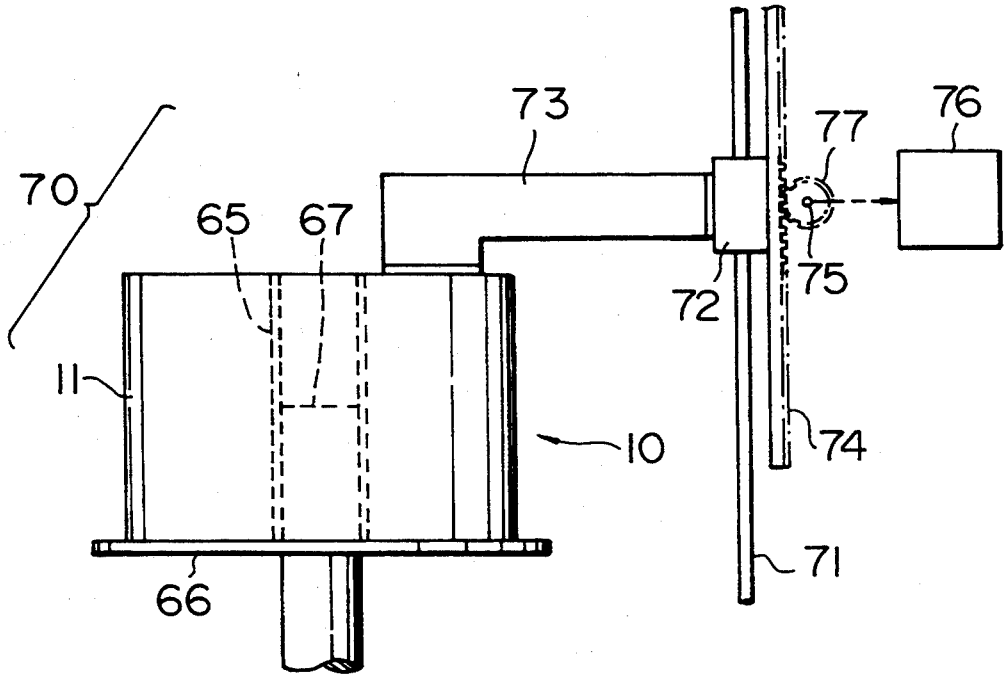
FIG. 5 is a schematic drawing showing a side view of a wrapping film width detection mechanism of a coin wrapping apparatus which is an embodiment of the present invention.

FIG. 5 is a schematic side view of a wrapping film width detection mechanism 70 of the coin wrapping apparatus 1 which is an embodiment of the present invention.

Referring to FIG. 5, a wrapping film roll 10 formed by winding a wrapping film 11 such as paper, plastic or the like around a cylindrical member 65 is placed on a turntable 66 in such a manner that a cylindrical member 67 fixed on the surface of the turntable 66 is fitted into the cylindrical member 65 of the wrapping film roll 10.

As shown in FIG. 5, the wrapping film width detection mechanism 70 of the coin wrapping apparatus 1 which is an embodiment of the present invention comprises a shaft 71, a block 72 mounted on the shaft 71 to be movable in the vertical direction and a detection lever 73 one end portion of which is fixed to the block 72 and the other end portion of which can contact the upper edge portion of the wrapping film roll 10. On the side of the block 72 opposite to the detection lever 73, a rack 74 is fixed and a pinion 77 whose shaft 75 is connected with a rotary encoder 76 meshes with the rack 74. As a consequence, if the value of the rotary encoder 76 when the detection lever 73 is in contact with the upper surface of the turn-table 66 is determined as a zero value of the width of the wrapping film 11, it is possible to detect the width of the wrapping film 11 by detecting an amount of vertical movement of the detection lever 73 along the shaft 71 by the rotary encoder 76.

Figure 6:
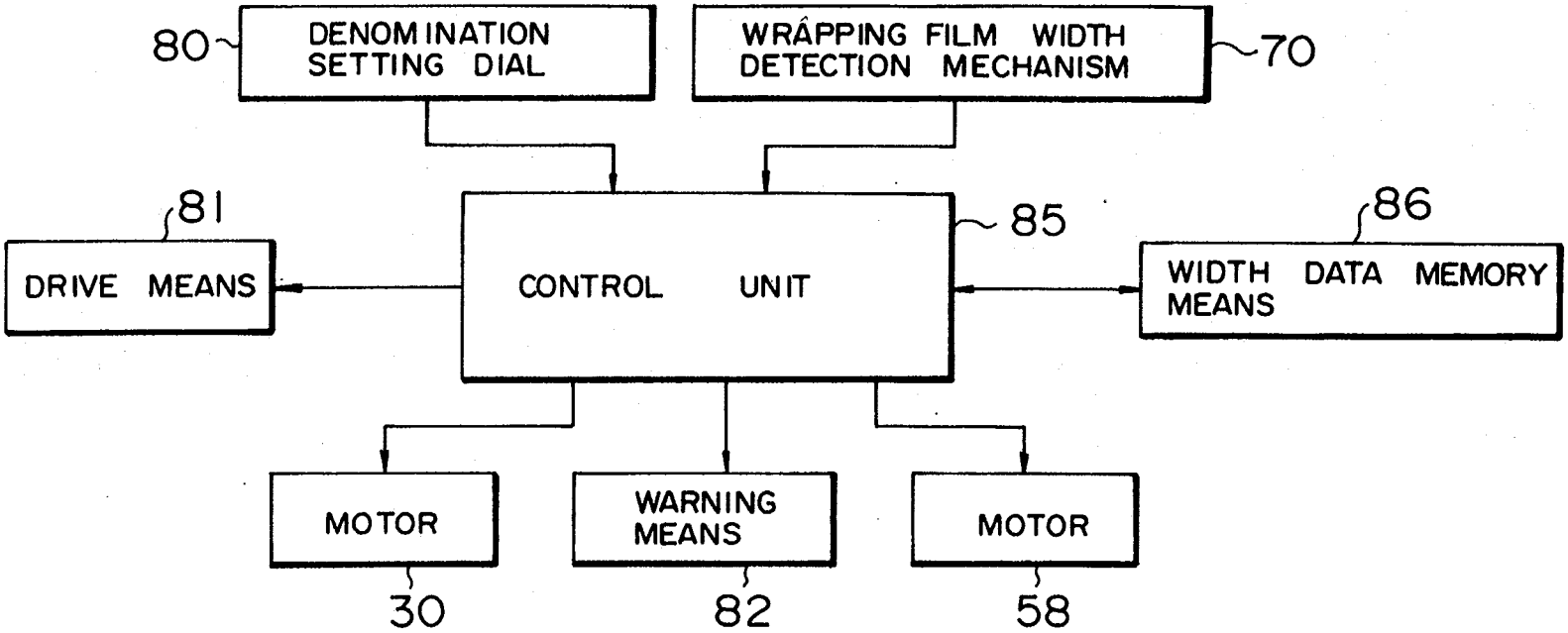
FIG. 6 is a block diagram showing a control mechanism for controlling a wrapping position setting mechanism and a coin support post moving mechanism of a coin wrapping apparatus which is an embodiment of the present invention, an operation mechanism, a detection mechanism, a drive mechanism and a message mechanism.

FIG. 6 is a block diagram showing a control mechanism for controlling the wrapping position setting mechanism 20 and the coin support post moving mechanism 40 of the coin wrapping apparatus 1 which is an embodiment of the present invention, an operation mechanism, a detection mechanism, a drive mechanism and a message mechanism.

In FIG. 6, the operation mechanism of the coin wrapping apparatus 1 which is an embodiment of the present invention comprises a denomination setting dial 80 operated by an operator for specifying the denomination of coins to be wrapped, the detection mechanism comprises the wrapping film width detection mechanism 70, the drive mechanism comprises drive means 81 for driving the rotary disk 3, the transporting belt 4, a motor (not shown) for adjusting the width of the coin sorting passage 5, a motor (not shown) for adjusting the space between the pair of stacking drums 6 and the like, the motor 30 and the motor 58, and the message mechanism comprises a warning means 82 for emitting a warning sound, respectively. The control mechanism for controlling the wrapping position setting mechanism 20 and the coin support post moving mechanism 40 comprises a control unit 85 and a wrapping film width memory means 86 for storing wrapping film width data.

When the denomination setting dial 80 is operated by an operator and the denomination of coins to be wrapped is set, the denomination setting dial 80 outputs a denomination set signal to the control unit 85 and when the wrapping film width detection mechanism 70 detects the width of the wrapping film 11, it outputs a width detection signal to the control unit 85.

The width data memory means 86 stores data necessary for producing wrapped coin rolls wrapped in a desired manner by crimping the upper and lower edge portions of the wrapping film 11 projecting from the ends of the roll of coins after the wrapping film 11 which has been wound around roll-like stacked coins 15. More specifically, the wrapping position where the roll-like stacked coins 15 are to be wrapped by the wrapping rollers 7 is set by the wrapping position setting mechanism 20 so that the vertical center position of the stacked coins 15 can coincide with the widthwise center position of the wrapping film 11. However, if the difference between the width of the wrapping film 11 and the height of the stacked coins 15 to be wrapped is less than a predetermined value, the widths of the wrapping film portions projecting from the upper and lower ends of the stacked coins 15 will be less than a predetermined value, while if the difference between the width of the wrapping film 11 and the height of the stacked coins 15 to be wrapped is greater than a predetermined value, the widths of the wrapping film portions projecting from the upper and lower ends of the stacked coins 15 will be greater than a predetermined value. In either case,the wrapping film 11 cannot be crimped in the desired manner to obtain the desired wrapped coin roll. Therefore, in this embodiment, the maximum tolerance value and the minimum tolerance value of the difference between the width of the wrapping film 11 and the height of the stacked coins 15 to be wrapped corresponding to each denomination of coins are determined in advance and are stored in the width data memory means 86.

The control unit 85 is adapted for calculating the difference between the width of the wrapping film 11 and the height of the stacked coins 15 of the denomination to be wrapped based upon the denomination setting signal input from the denomination setting dial 80, the maximum tolerance value and the minimum tolerance value corresponding to the denomination of coins to be wrapped and read out from the width data memory means 86 and a width detection signal input from the wrapping film width detection means 70, and judging whether or not the coins of the denomination set can be wrapped in a desired manner by using the wrapping film roll 10 placed on the turntable 66 by judging whether or not the difference between the width of the wrapping film 11 and the height of the stacked coins 15 of the denomination to be wrapped is equal to or less than the maximum tolerance value and is equal to or greater than the minimum tolerance value. When the control unit 85 judges that the coins of the denomination set cannot be wrapped in a desired manner by using the wrapping film roll 10 placed on the turn-table 66, it outputs a drive stop signal to the drive means 81, thereby stopping the drive of the coin wrapping apparatus 1 and outputs a warning signal to the warning means 82, thereby causing it to emit a warning sound. On the contrary, when the control unit 85 judges that the coins of the denomination set can be wrapped in a desired manner by using the wrapping film roll 10 placed on the turntable 66, it outputs a drive signal to the drive means 81, thereby causing it to rotate the first cam 32 so that the stacked coins 15 can be wrapped with the vertical center position of the stacked coins 15 coincident with widthwise the center position of the wrapping film 11.

In the thus constituted coin wrapping apparatus which is an embodiment of the present invention, initial setting of the apparatus is carried out before the wrapping of coins is begun. More specifically, the screw 25 is loosened and the shaft 21 and the block 22 are rotated with respect to the arm 23 by turning the adjusting screw 27, whereby the vertical position of the coin support post 9 is set via the second cam 33, the cam follower 54, the transmission member 45, the roller 46, the block 41 and the arm 43 so that the waiting position thereof can be set at a predetermined position. Thereafter, the screw 25 is tightened, thereby fixing the block 22 and the arm 23 to each other.

Once the initial setting has been completed, the coin wrapping apparatus 1 starts wrapping coins as follows.

At first, when the operator specifies the denomination of the coins to be wrapped by operating the denomination setting dial 80, a denomination setting signal is input from the denomination setting dial 80 to the control unit 85.

Based upon the denomination setting signal input from the denomination setting dial 80, the control unit 85 outputs drive signals to a motor (not shown) for adjusting the width of the coin sorting passage 5 and a motor (not shown) for adjusting the space between the pair of stacking drums 6, thereby setting the width of the coin sorting passage 5 so that only coins to be wrapped can pass therethrough and setting the space between the pair of stacking drums 6 so that coins of the denomination to be wrapped can be stacked therebetween.

Simultaneously, the control unit 85 reads out the maximum tolerance value and the minimum tolerance value of the wrapping film 11 corresponding to the denomination of coins to be wrapped from the width data memory means 86 based upon the denomination setting signal.

On the other hand, the wrapping film width detection mechanism 70 detects the vertical position of the detection lever 73 abutting against the upper edge portion of the wrapping film roll 10 by detecting the amount of rotation of the pinion 77 meshed with the rack 74 fixed to the block 72 to which the detection lever 73 is fixed by reading the rotary encoder 76 and produces a width detection signal, which it outputs to the control unit 85.

The control unit 85 calculates the difference between the width of the wrapping film roll 11 placed on the turntable 66 and the height of the stacked coins 15 to be wrapped based upon the denomination setting signal input from the denomination setting dial 80 and the width detection signal input from the wrapping film width detection mechanism 70.

Then, the control unit 85 judges whether or not the thus calculated difference between the width of the wrapping film roll 10, namely, the wrapping film 11 and the height of the stacked coins 15 to be wrapped is equal to or less than the maximum tolerance value and is equal to or greater than the minimum tolerance value read out from the width data memory means 86.

When the difference between the width of the wrapping film 11 and the height of the stacked coins 15 to be wrapped is greater than the maximum tolerance value or less than the minimum tolerance value read out from the width data memory means 86, since this means that the coins of the set denomination cannot be wrapped in a desired manner by using the wrapping film roll 10 currently on the turntable 66, the control unit 85 outputs a drive stop signal to the drive means 81, thereby stopping the operation of the coin wrapping apparatus 1 and outputs a warning signal to the warning means 82, thereby causing it to emit a warning sound. Consequently, the operator learns that the wrapping film roll 10 placed on the turn-table 66 is improper for wrapping coins of the denomination to be wrapped and replace the wrapping film roll 10 with a wrapping film roll 10 having the paper width so that the coin wrapping can be effected.

On the contrary, when the difference between the width of the wrapping film roll 11 and the height of the stacked coins 15 to be wrapped is equal to or less than the maximum tolerance value and is equal to or greater than the minimum tolerance value read out from the width data memory means 86, if the wrapping position is set by the wrapping position setting mechanism 20 in such a manner that the vertical center position of the stacked coins 15 coincides with the widthwise center position of the wrapping film 11 at the wrapping position, then since the coins of the set denomination can be wrapped in a desired manner by using the wrapping film roll 10 placed on the turntable 66, the control unit 85 outputs a drive signal to the motor 58 of the wrapping position setting mechanism 20, thereby rotating the first cam 32 of the wrapping position setting mechanism 20 so that the vertical center position of the stacked coins 15 coincides with the widthwise center position of the wrapping film 11 at the wrapping position thereof.

More specifically, the control unit 85 calculates the vertical center position of a predetermined number of stacked coins 15 to be wrapped based upon the denomination setting signal and calculates the widthwise center position of the wrapping film 11 so as to calculate an amount of rotation of the first cam 32 of the wrapping position setting mechanism 20 based upon the difference between the calculated values.

When the amount of rotation of the first cam 32 has been calculated, the control unit 85 outputs a drive signal to the motor 30 to rotate the first cam 32 about the cam shaft 31 by the calculated amount, whereby the cam follower 29 is rotated and the arm 23 is swung about the shaft 21.

As a result, the second cam 33 is moved together with the arm 23 so as to move the cam follower 54 abutting against the groove-like cam surface of the second cam 33, whereby the transmission member 45 is swung about the shaft 52 and the coin support post 9 is moved in the vertical direction so that the widthwise center position of the wrapping film roll 10 can coincide with the vertical center position of the stacked coins 15 at the wrapping position thereof.

Thus, when the vertical position of the coin support post 9 is set so that the widthwise center position of the wrapping film roll 10 can coincide with the vertical center position of the stacked coins 15 at the wrapping position thereof, the coin wrapping is started.

Coins deposited into the hopper 2 are fed onto the rotatable disk 3 by the transporting belt 4 and further fed into the coin sorting passage 5 one by one by a centrifugal force produced by the rotation of the rotatable disk 3. When the coins have been fed into the coin sorting passage 5, only coins of the denomination to be wrapped are sorted based on coin diameter in a well known manner and fed to between the pair of stacking drums 6 so as to be supported by the upper face of the spiral projections.

Each time the pair of stacking drums 6 receive a coin therebetween, they are rotated by a predetermined amount and when a predetermined number of coins to be wrapped have been stacked therebetween, the stacked coins 15 are fed onto the shutter (not shown).

On the other hand, the coin support post 9 is moved so that when the stacked coins 15 are fed onto the shutter, the coin support post 9 is located at the waiting position thereof immediately below the shutter and that it can receive the stacked coins 15 on the upper face thereof when the shutter is opened.

More specifically, the control unit 85 drives the motor 58 in accordance with coin detection signals input from a sensor (not shown) provided in the coin sorting passage 5, thereby rotating the third cam 57 counterclockwise in FIG. 2. Since the cam follower 56 rotatably mounted on the arm 53 abuts against the cam surface of the third cam 57, when the third cam 57 is rotated, the arm 53 is swung clockwise about the shaft 55 in FIG. 2 and the shaft 52 of the arm 53 is moved upwardly. At this time, the cam follower 54 of the transmission member 45 is guided by the groove-like cam surface of the third cam 57 and the transmission member 45 is swung clockwise about the shaft 52, whereby the coin support post 9 is moved upwardly via the roller 46, the groove 44, the block 41 and the arm 43. The cam profile of the third cam 57 is formed so that the coin support post 9 can be moved between the waiting position immediately below the shutter, the wrapping position between the three wrapping rollers 7 and the retracted position where the coin support post 9 is retracted downwardly from between the three wrapping rollers 7. FIG. 2 shows the coin support post 9 located at the retracted position.

When the shutter is opened, the coin support post 9 located at the waiting position thereof in this manner receives and supports the stacked coins 15 by the upper face thereof and is lowered in accordance with the rotation of the third cam 57 so as to be located at the wrapping position.

When the coin support post 9 has reached the wrapping position, the control unit 85 drives a wrapping film feed roller (not shown) so as to feed the wrapping film 11 from the wrapping film roll 10 placed on the turntable 66 to the wrapping rollers 7 and causes the wrapping rollers 7 to wind the wrapping film 11 around the stacked coins 15 supported on the upper face of the coin support post 9 in the well-known manner.

Figure 7:
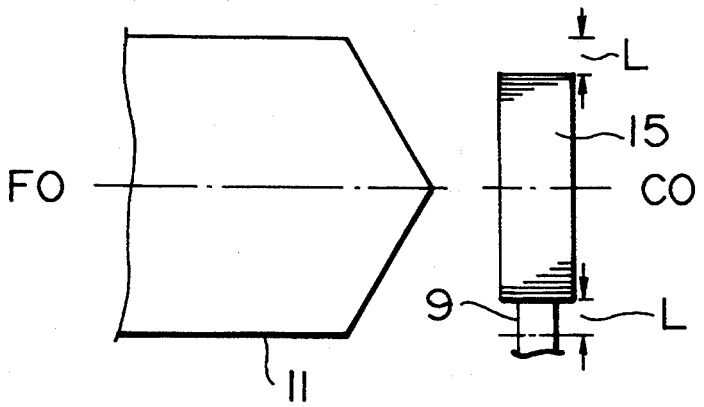
FIG. 7 is a schematic front view showing the relationship between stacked coins and a wrapping film when coin wrapping is started.

FIG. 7 is a schematic front view showing the relationship between the stacked coins 15 and the wrapping film 11 when the coin wrapping is started. As shown in FIG. 7, in this embodiment, since the vertical position of the coin support post 9 at the wrapping position thereof is set in accordance with the denomination of coins to be wrapped by the wrapping position setting mechanism 20 so that the vertical center position C0 of the stacked coins 15 supported on the upper face of the coin support post 9 coincides with the widthwise center position F0 of the wrapping film 11 fed to the wrapping rollers 7, the widths L of the upper and lower edge portions of the wrapping film 11 projecting from the upper and lower ends of the stacked coins 15 are the same.

When the wrapping film 11 is wound around the stacked coins 15 by the wrapping rollers 7, the upper and lower edge portions of the wrapping film 11 projecting from the upper and lower ends of the stacked coins 15 are crimped by the crimping claws (not shown). In this embodiment, since the widths L of the upper and lower edge portions of the wrapping film 11 projecting from the upper and lower ends of the stacked coins 15 are the same and have been set so that the stacked coins 15 can be wrapped in a desired manner when the wrapping film 11 is crimped by the crimping claws, a desired wrapped coin roll can be obtained.

Thus, when the crimping operation has been carried out by the crimping claws to some extent, the coin support post 9 is moved downward from between the three wrapping rollers 7 and held at the retracted position thereof. Afterward, the three wrapping rollers 7 are moved so as to be spaced from each other and, as a result, the wrapped coin roll drops to the outside through the chute 12.

According to this embodiment, if the cam profiles of the first cam 32 and the second cam 33 are formed in a proper manner, it is possible, even when coins having various thicknesses are wrapped, to automatically cause the vertical center position of a predetermined number of the stacked coins 15 to coincide with the widthwise center position of the wrapping film 11, equalize the widths L of the upper and lower edge portions of the wrapping film 11 projecting from the upper and lower ends of the stacked coins 15 and crimp the upper and lower edge portions of the wrapping film 11. Further, the maximum tolerance value and the minimum tolerance value of the difference between the width of the wrapping film 11 and the height of the stacked coins 15 to be wrapped are determined in advance and stored in the width data memory means 86 for each denomination of coins. Therefore, in the case (a) where the difference between the width of the wrapping film 11 and the height of the stacked coins 15 to be wrapped is lees than a predetermined value so that the width of the wrapping film 11 projecting from the upper and lower ends of the stacked coins 15 will be less than a predetermined value and (b) where the difference between the width of the wrapping film 11 and the height of the stacked coins 15 to be wrapped is greater than a predetermined value so that the width of the wrapping film 11 projecting from the upper and lower ends of the stacked coins 15 will be greater than a predetermined value, in either of which cases it is impossible to obtain a desired wrapped coin roll by crimping the wrapping film 11, a warning signal is output from the control unit 85 to the warning means 82 and a warning sound is emitted, enabling the operator to replace the wrapping film roll 10 on the turntable 66 with a wrapping film roll 10 having the proper width. It is therefore possible to wrap coins having various thicknesses in a desired manner.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, the width data memory means 86 stores the maximum tolerance value and the minimum tolerance value of the width of the wrapping film 11 projecting from the upper and lower ends of the stacked coins 15 and the control unit 85 calculates the difference between the width of the wrapping film 11 and the height of the stacked coins 15 to be wrapped based upon the width detection signal input from the wrapping film width detection mechanism 70 and the denomination setting signal input from the denomination setting dial 80 so that the control unit 85 compares the thus calculated difference with the maximum tolerance value and the minimum tolerance value and judges whether or not the wrapping film roll 10 on the turntable 66 can be used for wrapping coins. However, if maximum width tolerance data and minimum width tolerance data are determined in advance for each denomination of coins by adding the maximum tolerance value and the minimum tolerance value to the height of the stacked coins of each denomination and storing the result in the width data memory means 86, it is possible to judge whether or not the wrapping film roll 10 on the turntable 66 can be used for wrapping coins of the specified denomination without calculating the difference between the width of the wrapping film 11 and the height of the stacked coins 15 to be wrapped by reading out the maximum width tolerance data and the minimum width tolerance data from the width data memory means 86 and comparing them with the width of the wrapping film 11 detected by the wrapping film width detection mechanism 70.

Further, in the above described embodiment, although the denomination of the coins to be wrapped is specified by the denomination setting dial 80, if buttons for each denomination of coins are provided in an operation portion, the denominations of the coins to be wrapped may be specified by operating the buttons and if there are provided a counting means for counting the number of coins of each denomination and a returning mechanism for returning coins having been counted onto the rotatable disk 3, it is possible to automatically wrap coins in order from those of the denomination present in the largest number to those of the denomination present in the smallest number or in order from those of the denomination having the largest diameter to those of the denomination having the smallest diameter or in order from those of the denomination having the smallest diameter to those of the denomination having the largest diameter.

Furthermore, in the above described embodiment, although means for emitting a warning sound is employed as a warning means 82, it is possible to employ means for displaying a visual warning.

According to the present invention, it is possible to provide a coin wrapping apparatus which can ensure that wrapping film portions for crimping that have the same and desired width are formed to project from the upper and lower ends of a roll of a predetermined number of stacked coins irrespective of the coin thickness and the wrapping film width and which can produce wrapped coin rolls enabling the wrapping film to be crimped in a desired manner.

I claim:

1. A coin wrapping apparatus comprising denomination setting means to be operated by an operator for setting a denomination of coins to be wrapped, wrapping film width detection means for detecting a width of a wrapping film, coin stacking means for stacking coins to be wrapped, a plurality of wrapping rollers for winding the wrapping film around a predetermined number of stacked coins for wrapping, coin support means for supporting the stacked coins on an upper face thereof and coin support means moving mechanism for moving the coin support means between a waiting position where the stacked coins are to be received by the coin support means, a wrapping position where the stacked coins are to be wrapped by the wrapping rollers and a retracted position where the coin support means is retracted from the wrapping position, the coin wrapping apparatus further comprising wrapping position adjusting means for steplessly adjusting a vertical position of the coin support means at the wrapping position and control means for driving the wrapping position adjusting means based upon the denomination of coins to be wrapped which is set by the denomination setting means and the width of the wrapping film detected by the wrapping film width detection means so that a vertical center position of the stacked coins supported by the coin support means coincides with a widthwise center position of the wrapping film at the wrapping position.

2. A coin wrapping apparatus in accordance with claim 1 which further includes wrapping film width data storing means for storing width data on the width of the wrapping film suitable for wrapping stacked coins of each denomination and warning means and wherein the control means is adapted for reading from the wrapping film width data storing means the width data on the wrapping film corresponding to the denomination of coins to be wrapped which is set by the denomination setting means, judging, based upon the denomination set by the denomination setting means and the width of the wrapping film detected by the wrapping film width detection means, whether or not the coins to be wrapped can be wrapped by the wrapping film and, if they cannot, outputting a warning signal to the warning means, thereby causing it to produce a warning.

3. A coin wrapping apparatus in accordance with claim 2 wherein the wrapping film width data storing means stores, as the width data on the wrapping film, a maximum value and a minimum value of the width of the wrapping film able to wrap each denomination of coins and the control means is adapted for calculating a difference between the width of the wrapping film and a height of the stacked coins based upon the denomination set by the denomination setting means and the width of the wrapping film detected by the wrapping film width detection means and judging whether or not the coins of the denomination set by the denomination setting means can be wrapped by the wrapping film.

4. A coin wrapping apparatus in accordance with claim 2 wherein the wrapping film width data storing means stores, as the width data on the wrapping film, a maximum tolerance value and a minimum tolerance value of a difference between the width of the wrapping film and a height of the stacked coins of the denomination set by the denomination setting means for each denomination of coins and the control means is adapted for calculating the difference between the width of the wrapping film and the height of the stacked coins to be wrapped based upon the width of the wrapping film detected by the wrapping film width detection means and the denomination of coins to be wrapped which is set by the denomination setting means and judging whether or not the coins of the denomination set by the denomination setting means can be wrapped by the wrapping film by comparing the difference with the maximum tolerance value and the minimum tolerance value.

* * * * *